US006786116B2

(12) United States Patent
Dockery

(10) Patent No.: US 6,786,116 B2
(45) Date of Patent: Sep. 7, 2004

(54) POLE APPARATUS HAVING INTERCHANGEABLE TOOL HEADS

(76) Inventor: Forrest Dockery, 5158 Goldman Ave. #A, Moorpark, CA (US) 93021

( * ) Notice: Subject to any disclaimer, the term of this patent is extended or adjusted under 35 U.S.C. 154(b) by 0 days.

(21) Appl. No.: 09/757,043

(22) Filed: Jan. 9, 2001

(65) Prior Publication Data

US 2002/0088313 A1 Jul. 11, 2002

(51) Int. Cl.[7] ..... B25B 23/16

(52) U.S. Cl. ..... 81/177.1; 81/177.2; 81/177.85; 81/125; 81/124.2; 279/46.3

(58) Field of Search ..... 81/177.1, 177.85, 81/489, 125, 53.1, 124.5, 124.2, 121.1, 177.2; 294/19.1; 279/43, 46.3, 48, 52, 43.2, 83

(56) References Cited

U.S. PATENT DOCUMENTS

| | | | | | |
|---|---|---|---|---|---|
| 1,320,181 | A | * | 10/1919 | Smith | 279/43 |
| 1,417,683 | A | * | 5/1922 | Parsons | 81/177.2 |
| 2,670,963 | A | * | 3/1954 | Osborn | 279/53 |
| 4,413,660 | A | | 11/1983 | Conrad | 140/119 |
| 4,689,881 | A | | 9/1987 | Fall | 29/813 |
| 4,724,731 | A | | 2/1988 | Onofrio | 81/119 |
| 5,012,624 | A | | 5/1991 | Dahlgren | 52/484 |
| 5,154,104 | A | * | 10/1992 | O | 81/177.2 |
| 5,363,525 | A | | 11/1994 | Andreasen | 7/138 |
| 5,439,338 | A | | 8/1995 | Rosenberg | 411/400 |
| 5,507,209 | A | | 4/1996 | Allen et al. | 81/124.2 |
| 5,809,851 | A | | 9/1998 | Thompson | 81/124.2 |
| 6,155,576 | A | * | 12/2000 | Yorde | 279/49 |

* cited by examiner

*Primary Examiner*—Debra S Meislin
(74) *Attorney, Agent, or Firm*—Gifford, Krass, Groh, Sprinkle, Anderson & Citkowski, P.C.

(57) ABSTRACT

A pole apparatus having a telescoping tubular body, an open end and a closed end the body and defining an aperture extending into the interior of the body. A first connector is mounted on the open end of the body and includes an axial bore that is in communication with the interior of the body. A second connector may be mounted on the closed end of the body and includes a base and an arm extending outwardly from said base and in axial alignment with the body. Finally, there is also disclose a tool having and head portion and a separate mounting portion adapted to engage and be removably secured within the bore of the first connector.

9 Claims, 6 Drawing Sheets

POLE APPARATUS HAVING INTERCHANGEABLE TOOL HEADS

BACKGROUND OF THE INVENTION

1. Field of the Invention

The present invention is directed to a pole apparatus. More specifically, the present invention is directed to a pole apparatus having removable and interchangeable tool heads for use, for example, in fastening electrical and acoustical hardware to ceilings.

2. Reference to Related Art

Pole tools such as a lag pole are known in the prior art for their utility in assisting with the installation of electrical and suspended ceiling hanging hardware. Typically, a tool, such as lag driver that is adapted to hold screws or similar fasteners for subsequent mounting in the ceiling, is permanently affixed to the end of the pole. A bore and/or aperture may also be defined through the pole and tool such that wire or threaded rod may be communicated through the pole and tool for connection to the fastener.

Among the prior art tools are U.S. Pat. No. 5,012,624 issued May 7, 1991 to Dahlgren. Dahlgren discloses a system for suspending a structural member from a ceiling using a pole-mounted tool to install anchor members. Similarly, U.S. Pat. No. 4,724,731 issued Feb. 16, 1988 to Onofrio discloses a lag driver for use with a standard drill.

SUMMARY OF THE INVENTION

The present invention is directed to a pole apparatus. Preferably, the pole apparatus includes a tubular body having at least two telescoping body sections. An aperture is defined in the side of the pole body to permit access into the interior of the pole. A first connector is preferably fixed at one end of the body and defines an axial bore that communicates with the interior of the body. A tool is removably disposed in the connector. Preferably, the tool includes a mounting portion that engages and is removably secured within the connector. Furthermore, the tool includes a head portion that is adapted to carry out a specific task. Additionally, a second connector is disposed on the opposite end of the body. Preferably, the second connector includes a base and an arm in axial alignment with the body that is adapted to engage a drill.

BRIEF DESCRIPTION OF THE DRAWINGS

The present invention may be more clearly understood when viewed in connection with the accompanying drawings wherein similar reference numerals refer to similar parts throughout and wherein.

DETAILED DESCRIPTION OF A PREFERRED EMBODIMENT

Figure 1:
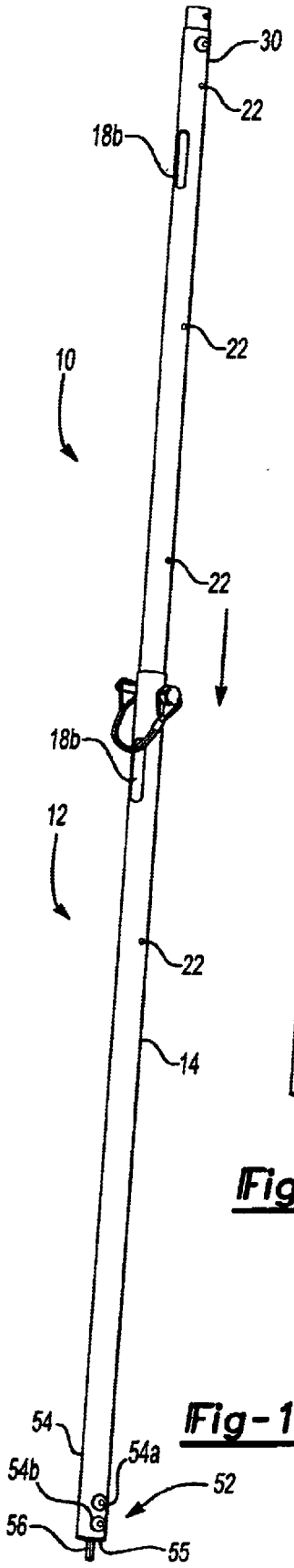
FIG. 1 is a perspective view of a preferred embodiment of a pole apparatus constructed in accordance with the present invention showing telescoped body sections.
Figure 2:
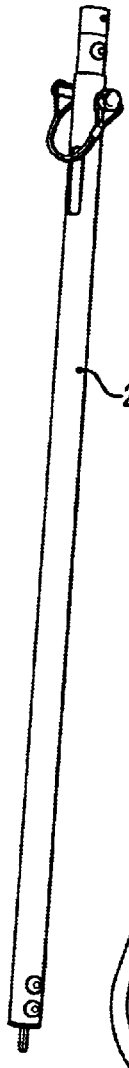
FIG. 2 is a perspective view of the preferred embodiment showing collapsed body sections.
Figure 3:
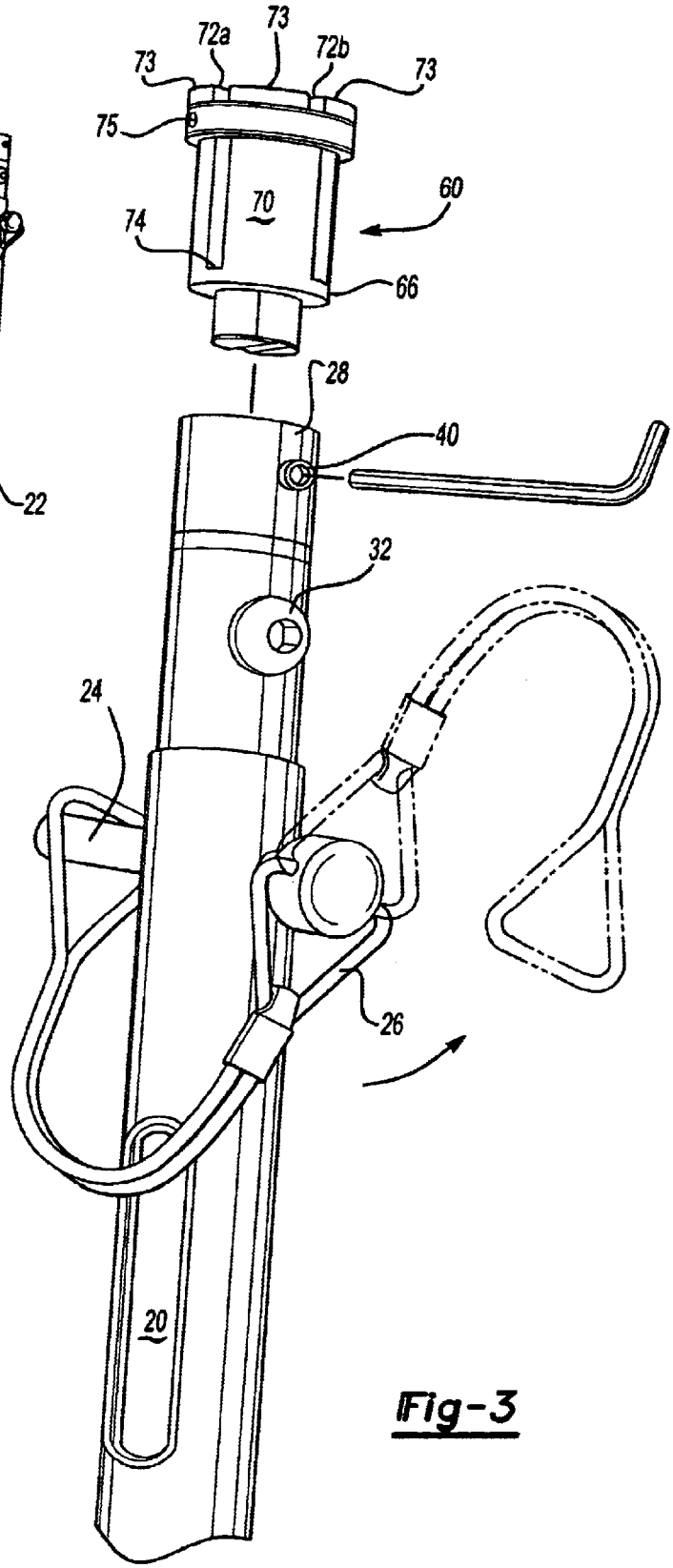
FIG. 3 is an enlarged perspective view of the preferred embodiment.

Referring now to FIGS. 1–3, there is shown a preferred embodiment of a pole apparatus 10 constructed in accordance with the present invention. Preferably, the pole apparatus 10 of the present invention includes a body 12 having at least a first 14 and a second 16 telescoping body member. Preferably, the body has a tubular shape and cross-section and is constructed of steel. However, it is appreciated other shapes (i.e., a square or triangular shaped body) and materials (i.e., aluminum or alloys) may also be utilized to construct the present invention.

Preferably, the apertures 18*a* and 18*b* are defined in the side of each body section 14, 16 to permit access into the interior 20 of the body 12. As best seen in FIG. 2, when the telescoping sections 18*a*, 18*b* of the body 12, are in a non-telescoped or collapsed orientation, the respective apertures 18*a*, 18*b* of the body sections 14, 16 are in radial alignment with one another.

A plurality of opposing bores 22 (see FIG. 1; only one side shown) are disposed at predetermined lengths along the body 12. Preferably, the bores are engaged by a pin 24 such that the body sections 14, 16 are secured in either a telescoped or collapsed position depending upon the needs of the user. A clasp 26 is also preferably disposed on the pin 24 such that the pin 24 is removably retained within the bore 22.

Figure 4:
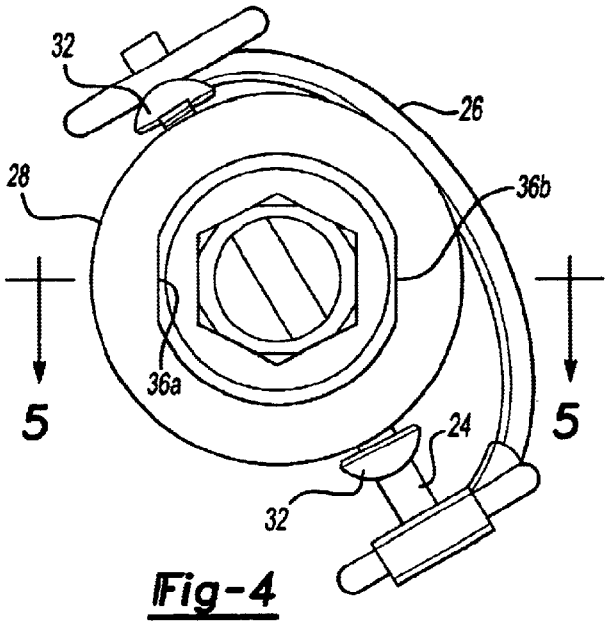
FIG. 4 is a planar view of the end of the body showing the first connector of the preferred embodiment.
Figure 5:
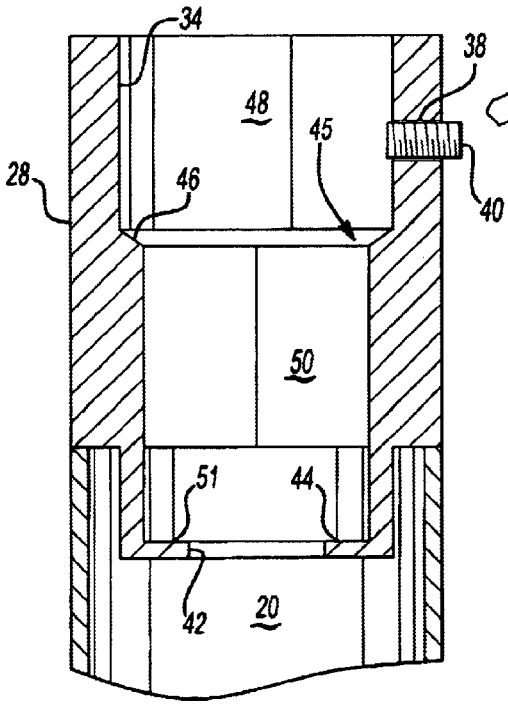
FIG. 5 is a planar cross-sectional view of the connector of the preferred embodiment.

Referring now to FIGS. 3–5, a first connector 28 is fixedly mounted at one end 30 of the pole apparatus 10 by screws 32. As best shown in FIGS. 4 and 5, the first connector 28 is preferably a female connector having a substantially circular inner wall 34. Alternatively, the inner wall 34 may be of most any design that is convenient for the user (e.g., square, rectangular, oval, starred, etc.) The inner wall 34 includes a pair of planar alignment faces 36*a*, 36*b*. Alternatively, the alignment faces 36*a*, 36*b* may be constructed such they are notched or grooved and thereby permit a male member to mate in a predetermined orientation. It is also appreciated the first connector 28 may also be constructed to have only a single alignment face 36. A threaded aperture 38 is defined in the first connector 28 and is engaged by a locking screw 40, the function of which will be described below.

Preferably, a bore 42 is defined though an interior floor 44 of the first connector 28. The bore 42 preferably extends through the floor 44 and communicates with the interior 20 of the body 12 of the pole apparatus 12. A tapered seat 46 is formed in the connector 28, the function of which will be described below.

Figure 12:
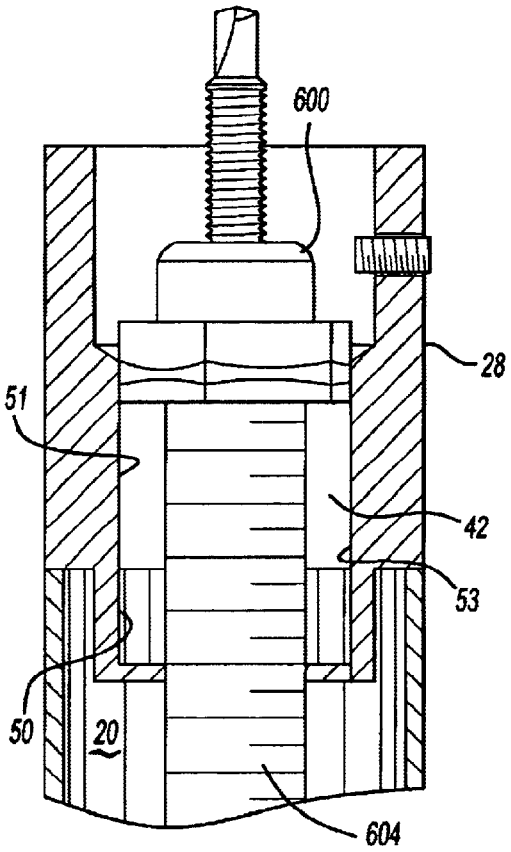
FIG. 12 is a planar cross-sectional view showing a pole apparatus of the present invention with a threaded rod screw.
Figure 13:
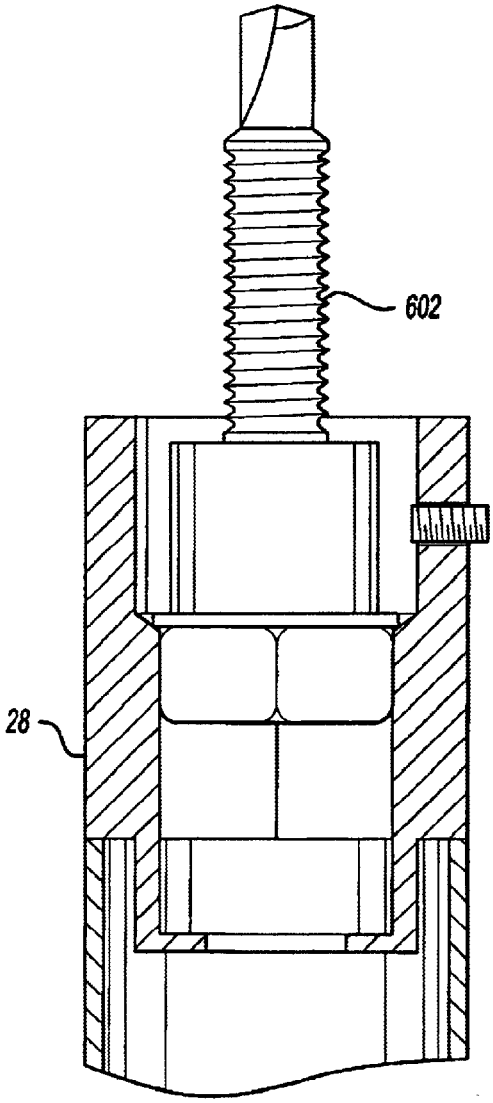
FIG. 13 is a planar cross-sectional view showing a pole apparatus of the present invention with a second threaded rod screw.

As best seen in FIG. 5, the bore 42 includes an upper portion 48 and a lower portion 50 having offset sidewalls that are substantially hexagonal in shape. Preferably, the upper 48 and lower 50 portion of the bore 42 have the same diameter. However, it is appreciated that the upper portion 48 may be constructed to have a diameter that is greater than that of the lower portion 50. Additionally, a base 51 of the bore 42 is preferably circular and has a diameter that is equal to or less than that of the lower portion 50. As best seen in FIGS. 12 and 13, the hexagonal shape of the upper 48 and lower portions of the bore 42 permit it to receive various sizes of commercially available rod hanger screws having a hex base, such as those produced by Elco under the name HangerMate®.

Referring again to FIGS. 1 and 2, second connector 52 is fixedly mounted at the other end 54 of the pole apparatus 10 by a pair of screws 54*a*, 54*b*. Preferably, the second connector 52 includes a base 55 having a hexagonal shaped arm 56 extending outwardly from the 54 and in axial alignment with the body 12. The arm 56 is preferably hexagonal so that it may readily engage a standard power drill (not shown).

Figure 6:
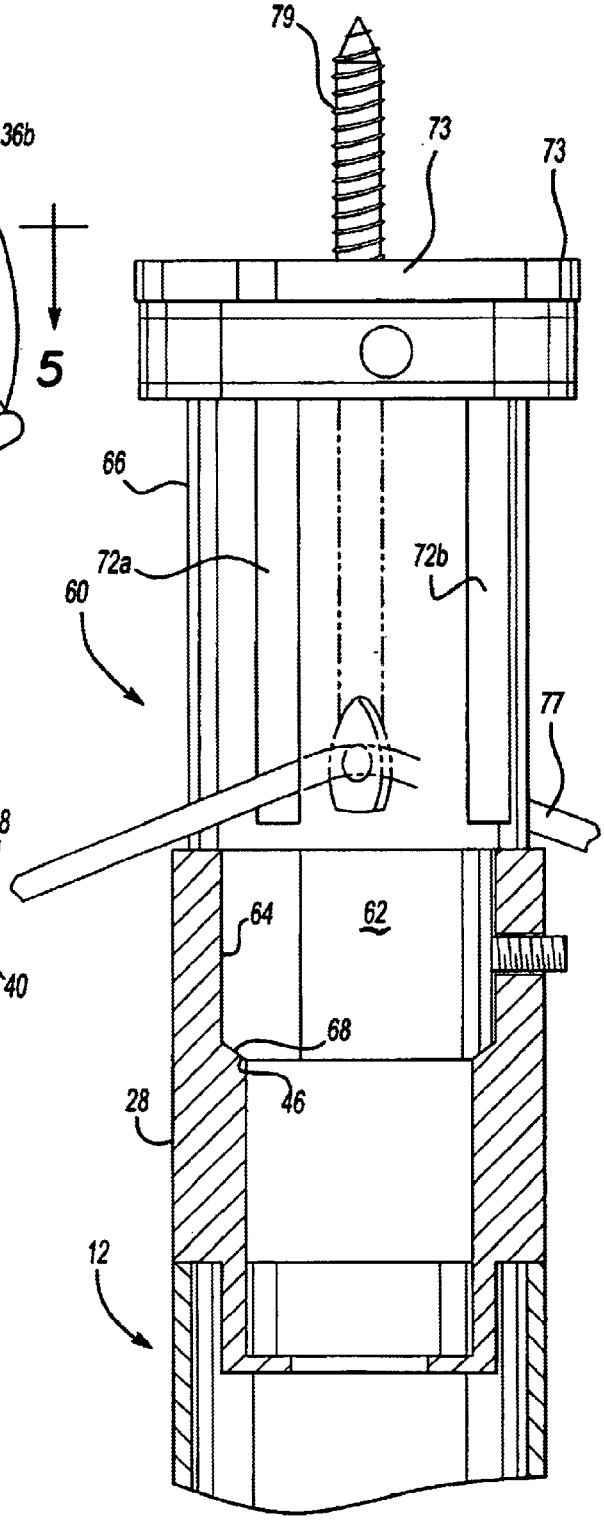
FIG. 6 is a partial cross-sectional view of the connector with a preferred embodiment of a tool.

Referring now to FIGS. 3 and 6, a tool 60 is shown in removable engagement with the first connector 28 on the body 12 of the pole apparatus 10. Preferably, the tool 60 includes a mounting portion 62 having at least one planar alignment face 64 and a head portion 66 for use in connecting fasteners, anchors or the like. The mounting portion 62 of the tool 60 is adapted to be releasably secured within the first connector 28. Specifically, the mounting portion 62 of the tool 60 is inserted into the first connector 28 with the alignment face(s) 64 of the mounting portion 62 aligned with the face(s) 36*a*, 36*b* of the internal wall 34 of the connector 28. Preferably, a tapered end 68 of the mounting portion contacts and is further supported by the seat 46 of the first connector 28. After the mounting portion 62 is positioned within the first connector 28, the mounting portion 62 and thus the tool 60 is secured by the inward rotation of the locking screw 40. It is appreciated that the function locking screw 40 to secure the tool 60 may be accomplished by a variety of structures that are well-known in the art such as a quick disconnect system, spring bias teeth or a spring bias pin.

Preferably, the head portion 66 of the tool 60 of the preferred embodiment includes a steel, or alternatively aluminum, cylinder 70 having a pair of perpendicular channels 72*a*, 72*b* extending substantially the entire length of the cylinder. The channels 72*a*, 72*b* thereby forming four head segments 73 extending upwardly from a base 74. A retainer ring 75 is preferably disposed around the cylinder 70 and contacts flanges 76 that extend from the upper portion of each of the segments 73.

Figure 7:
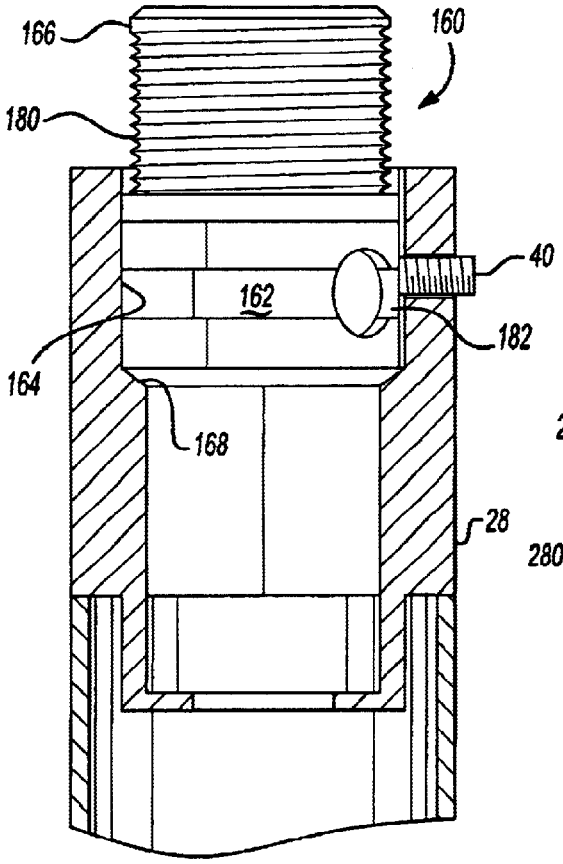
FIG. 7 is a planar cross-sectional view showing a first alternative embodiment of a tool.

Referring now to FIG. 7, there is shown a first alternative embodiment for a tool for use in accordance with the present invention. Preferably, the head portion 166 of the first alternative tool 160 includes a threaded stud 180. The stud 180 preferably functions as an adapter for mounting Viper™ type power actuated tools. Additionally, this embodiment may also function as an adapter for Caddy's® VAFT tool and Minerallac's™ tools. Preferably, this first alternative tool 160 includes a mounting portion 162 having at least one planar alignment face 164 and a tapered end 168. The tool 160 is therefore is inserted and seated into the first connector 28 as previous discussed. However, a mounting channel 182 is also preferably disposed about in the mounting portion 162 and is engagable by the locking screw 40 after insertion of the tool 160.

Figure 8:
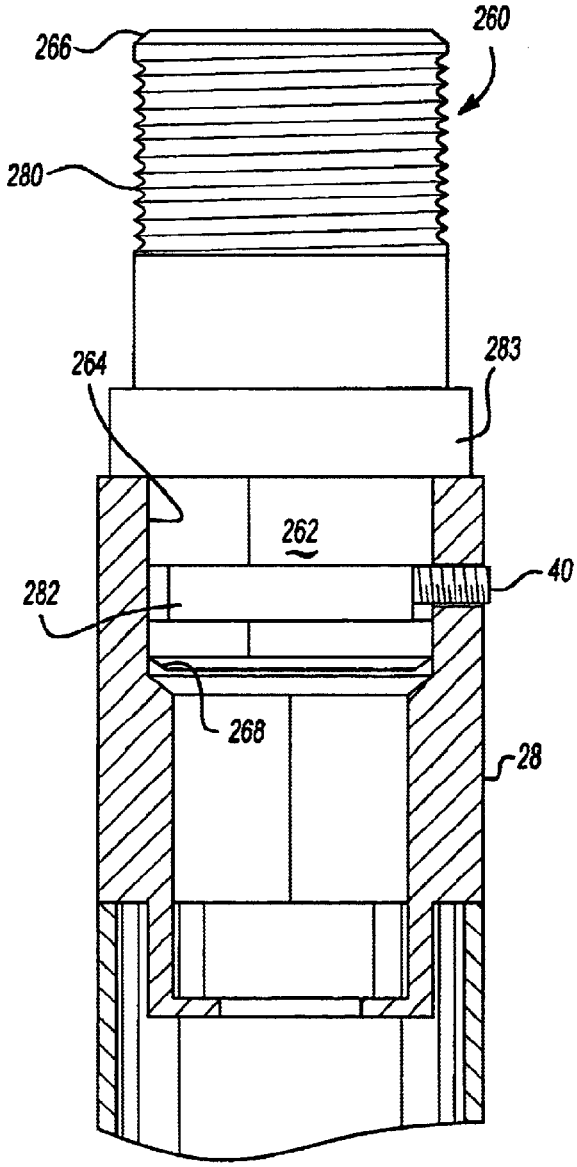
FIG. 8 is a planar cross-sectional view showing a second alternative embodiment of a tool.

Referring now to FIG. 8, there is shown a second alternative embodiment for a tool for use in accordance with the present invention. The head portion 266 of the first alternative tool 260 includes a threaded stud 280 extending upwardly from a substantially circular base 282. The stud 280, similar to the first alternative embodiment, functions as an adapter for mounting Ramsets S Caps. Preferably, this second alternative tool 260 includes a mounting portion 262 having at least one planar alignment face 264 and a tapered end 268. The tool 260 is therefore inserted and seated into the first connector 28 as previous discussed. A mounting channel 282 is also preferably disposed about the mounting portion 262 and is engagable by the locking screw 40 after insertion of the tool 260. Upon insertion, the base 283 is preferably seated on the top of the first connector 28.

Figure 9:
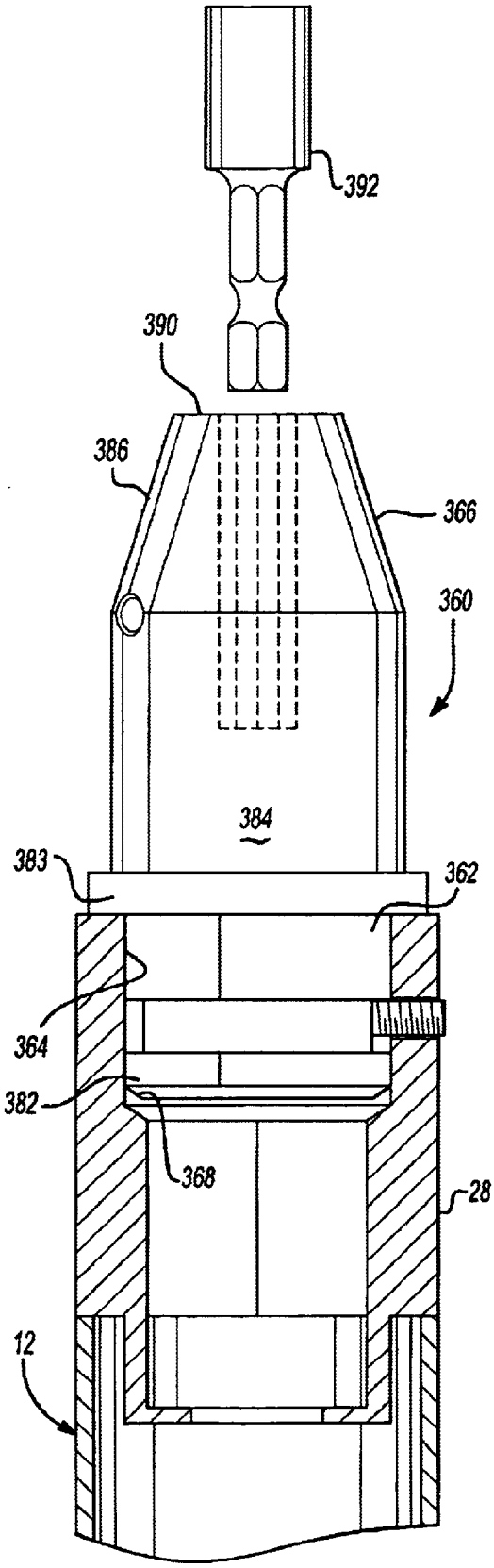
FIG. 9 is a planar cross-sectional view showing a third alternative embodiment of a tool.

Referring now to FIG. 9, there is shown a third alternative embodiment of a tool for use in connection with the present invention. The head portion 366 of the third alternative tool 360 preferably includes a cylindrical body 384 extending upwardly from a base 383 and a tapered top portion 386. A hexagonal bore 388 in axial alignment with the body 12 and having a predetermined diameter, extends into the body 384 from its top surface 390 and is adapted to receive a standard hex driver (e.g., a ¼' hex driver). Preferably, the third alternative tool 360 includes a mounting portion 362 having at least one planar alignment face 364 and a tapered end 368. The tool 360 is therefore inserted and seated into the first connector 28 as previously discussed. A mounting channel 382 is also preferably disposed about in the mounting portion 362 and is engagable by the locking screw 40 after insertion of the tool 360. Upon insertion, the base 382 is preferably seated on the top of the first connector 28.

Figure 10:
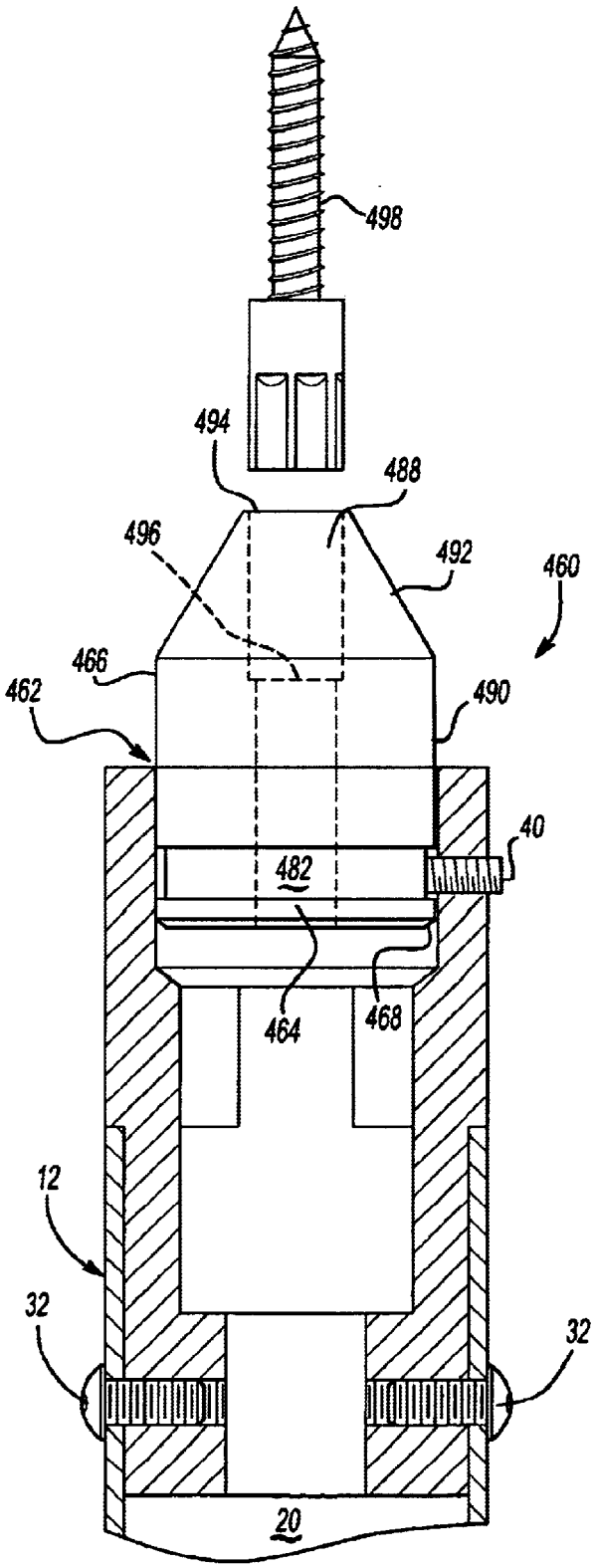
FIG. 10 is a planar cross-sectional view showing a fourth alternative embodiment of a tool.

Referring now to FIG. 10, there is shown a fourth alternative embodiment of a tool for use in connection with the present invention. Preferably, the head portion 466 of the third alternative tool 460 includes a cylindrical body 490 having tapered top portion 492. A bore 488 in axial alignment with the body 12 and having a predetermined diameter extends through the body 490 from its top surface 494 to communicate with the interior 20 of the body 12. Preferably, the bore 488 includes a seat 496 for support and is adapted to receive a standard screw 498 for hanging threaded rods (e.g., Sammy Super Screws® or HangerMate® screws). Notably, when hanging threaded rod, the rod (not shown) will extend downwardly through the bore 488 and into the interior 20 of the body 12. Preferably, this fourth alternative tool 460 includes a mounting portion 462 having at least one planar alignment face 464 and a tapered end 468. The tool 460 is therefore inserted and seated into the first connector 28 as previous discussed. A mounting channel 482 is also preferably disposed in the mounting portion 462 and is engagable by the locking screw 40 after insertion of the tool 460.

Figure 11A:
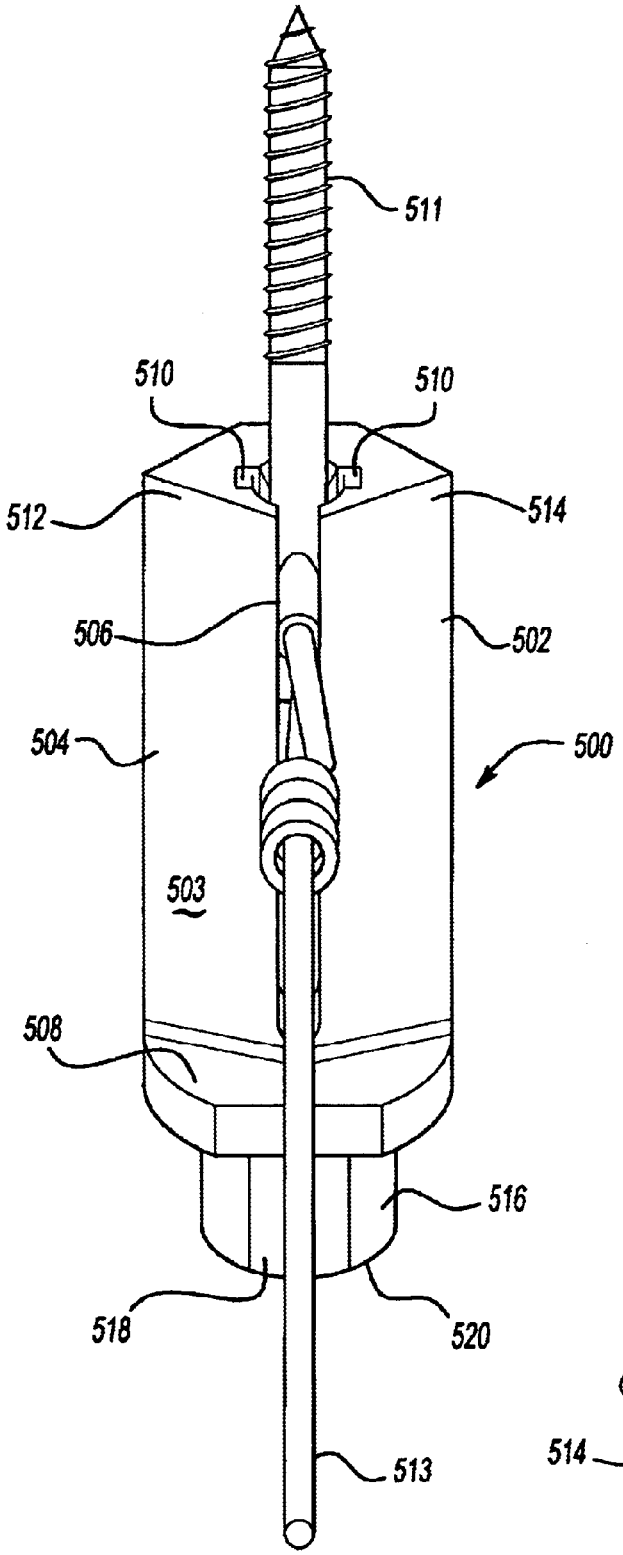
FIG. 11A is a planar cross-sectional view showing a fifth alternative embodiment of a tool.
Figure 11B:
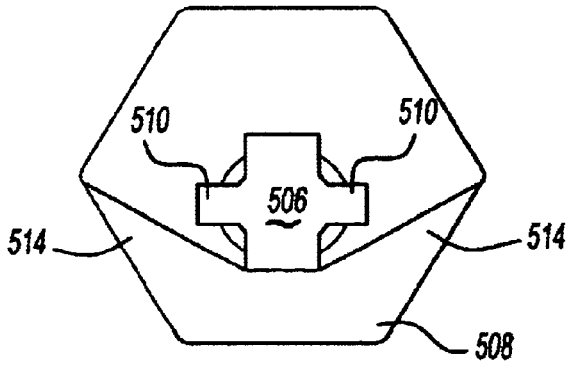
FIG. 11B is a planar top view showing the fifth alternative embodiment of a tool.

Referring now to FIGS. 11A and 11B, there is shown a fifth alternative embodiment of a tool 500 for use in connection with the present invention. Preferably, the head portion 502 of the fifth alternative tool 500 includes a body 504 having a central channel 506 in axial alignment with the body 12 that extends from a top surface to a base 508. At least one, but preferably two secondary channels 510 extend from and perpendicular to the central channel 506. The combination of the central channel 506 and secondary channel 510 create a generally cross-shaped opening in the top surface such that an "S" hook, eye lag screw with entrained wire or the like is insertable into the channels. A front surface of the head portion includes a first 512 and a second 514 wall that extend away from either side of the central channel 502 at an acute angle relative to the channel 502. Preferably, the fifth alternative tool 500 includes a mounting portion 516 having at least one planar alignment face 518 and and end 520 that contacts the seat 46 of the connector 28. The tool 500 is therefore inserted and seated into the first connector 28 as previously discussed. After the mounting portion 516 is positioned within the first connector 28, the tool 500 is secured by the inward rotation of the locking screw 40.

While there has been shown what is considered to be the preferred and alternative embodiments of the invention, it is desired to secure in the appended claims all modifications as fall within the spirit and scope of the invention.

I claim:

1. A pole apparatus for use in the installation of a suspended ceiling comprising:

a telescoping body having an interior, an open end and a closed end, and defining an aperture that permits access into said interior, a first connector mounted on said open end of said body, said first connector defining a first axial bore in communication with said interior of said body and having a locking apparatus adapted to extend into said axial bore, said first connector further defining a second axial bore;

a second connector mounted on said closed end of said body, said second connector having a base and an arm extending outwardly from said base in axial alignment with said body, said arm being engagable by a rotary tool;

a tool having a mounting portion adapted to engage said second axial bore of said first connector, said tool being removably secured to said first connector by said locking apparatus; and a fastener removably supported on said tool.

2. The pole apparatus of claim 1, wherein said first connector further comprises at least one alignment face.

3. The pole apparatus of claim 1, wherein said first connector further comprises a hexagonal side wall.

4. The pole apparatus of claim 1, wherein said locking apparatus comprises a locking screw.

5. The pole apparatus of claim 1, wherein said locking apparatus comprises a quick disconnect system.

6. The pole apparatus of claim 5, wherein said quick disconnect system comprises spring biased teeth.

7. The pole apparatus of claim 1, wherein said quick disconnect system comprises a spring biased pin.

8. The pole apparatus of claim 1, wherein said second connector further comprises a hexagonal surface.

9. A pole apparatus for use in installation of a suspended ceiling comprising:

elongated body having a first end and a second end whereby said elongated body is a telescoping tubular body having an interior, an open and a closed end and defining an aperture that permits access into said interior:

a connector positioned on said first end of said body; and a tool removably secured to said connector, the tool having a body, the body having a first and a second channel defined therein, the channels extending perpendicular to each other.

* * * * *